US010033139B2

(12) United States Patent
Sinton et al.

(10) Patent No.: US 10,033,139 B2
(45) Date of Patent: Jul. 24, 2018

(54) DURABLE INTERFACE FOR WIPING ELECTRICAL CONTACTS

(71) Applicants: Alex J. Sinton, Doylestown, PA (US); Nathaniel J. Bower, Doylestown, PA (US); David P. Pora, Reigelsville, PA (US)

(72) Inventors: Alex J. Sinton, Doylestown, PA (US); Nathaniel J. Bower, Doylestown, PA (US); David P. Pora, Reigelsville, PA (US)

(73) Assignee: ROCAL CORPORATION, Warrington, PA (US)

( * ) Notice: Subject to any disclaimer, the term of this patent is extended or adjusted under 35 U.S.C. 154(b) by 0 days.

(21) Appl. No.: 15/367,842

(22) Filed: Dec. 2, 2016

(65) Prior Publication Data

US 2018/0159271 A1 Jun. 7, 2018

(51) Int. Cl.

| | |
|---|---|
| ***H01R 13/28*** | (2006.01) |
| ***H01R 13/631*** | (2006.01) |
| ***H01R 13/639*** | (2006.01) |

(52) U.S. Cl.

CPC ..... *H01R 13/631* (2013.01); *H01R 13/639* (2013.01)

(58) Field of Classification Search

CPC ..... H01R 13/28; H01R 23/27
USPC ..... 439/295, 660, 924.1
See application file for complete search history.

(56) References Cited

U.S. PATENT DOCUMENTS

| | | | | |
|---|---|---|---|---|
| 3,091,746 | A * | 5/1963 | Winkler | H01R 13/28 439/295 |
| 3,259,870 | A | 7/1966 | Winkler | |
| 3,903,385 | A * | 9/1975 | Moyer | H01R 12/721 200/243 |
| 4,335,931 | A * | 6/1982 | Kinnear | H01R 13/28 439/295 |
| 4,582,376 | A * | 4/1986 | Olsson | H01R 13/7032 200/51.1 |
| 4,737,118 | A * | 4/1988 | Lockard | H01R 23/27 439/293 |
| 6,447,317 | B1 * | 9/2002 | Billman | H01R 12/88 439/108 |
| 6,994,595 | B2 | 2/2006 | Baker | |
| 7,001,194 | B2 * | 2/2006 | Yang | H01R 23/27 439/295 |
| 7,153,152 | B1 * | 12/2006 | Eby | H01R 4/185 439/295 |
| 7,494,359 | B2 | 2/2009 | Ragnarsson | |
| 7,628,630 | B2 * | 12/2009 | Chang | H01R 13/28 439/295 |
| 7,833,039 | B2 | 11/2010 | Chang | |
| 7,887,353 | B2 | 2/2011 | Bethurum | |
| 7,938,672 | B2 | 5/2011 | Zhu | |
| 8,357,017 | B2 | 1/2013 | Xu | |
| 8,568,152 | B1 * | 10/2013 | Weeks | H05K 5/02 439/137 |

(Continued)

*Primary Examiner* — Gary Paumen
(74) *Attorney, Agent, or Firm* — Cusick IP, PLLC; Clinton J. Cusick, Esq.

(57) ABSTRACT

A durable low friction interface for electrical connections that delays contact between conductive materials until a substantial portion of insertion has been completed. A terminal plug embodiment and a coupling embodiment are disclosed, each containing a durable low friction interface.

27 Claims, 11 Drawing Sheets

(56) References Cited

U.S. PATENT DOCUMENTS

| | | | | |
|---|---|---|---|---|
| 8,944,836 | B2 | 2/2015 | Mori | |
| 2003/0139083 | A1 | 7/2003 | Huang | |
| 2007/0254507 | A1* | 11/2007 | Shen | H01R 12/79<br>439/159 |
| 2009/0093149 | A1 | 4/2009 | Mancini | |
| 2012/0122332 | A1* | 5/2012 | Zhu | H01R 12/73<br>439/345 |
| 2013/0102177 | A1 | 4/2013 | Venaleck | |

* cited by examiner

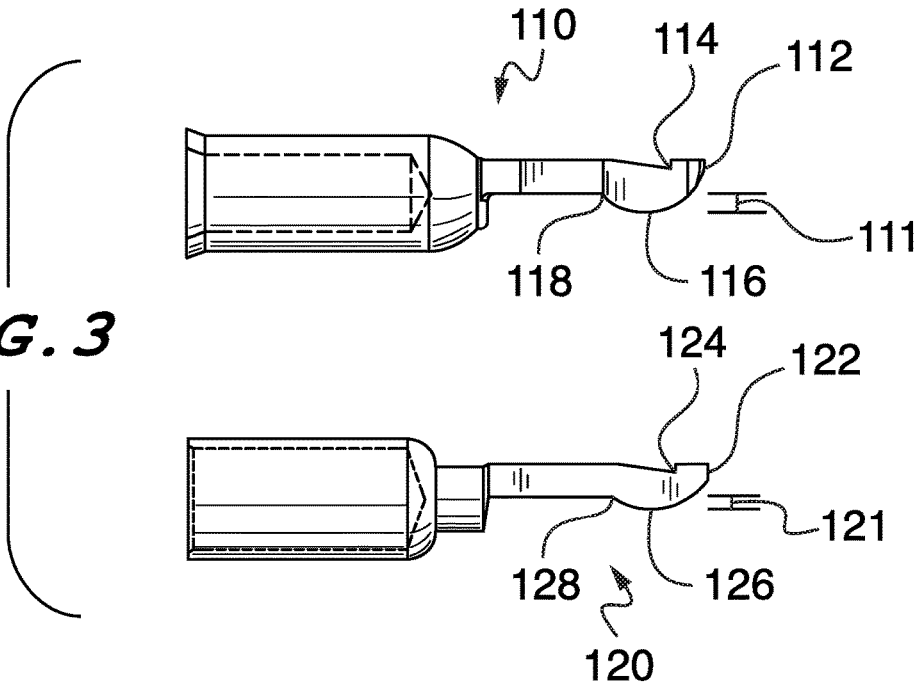
FIG. 3
FIG. 4A
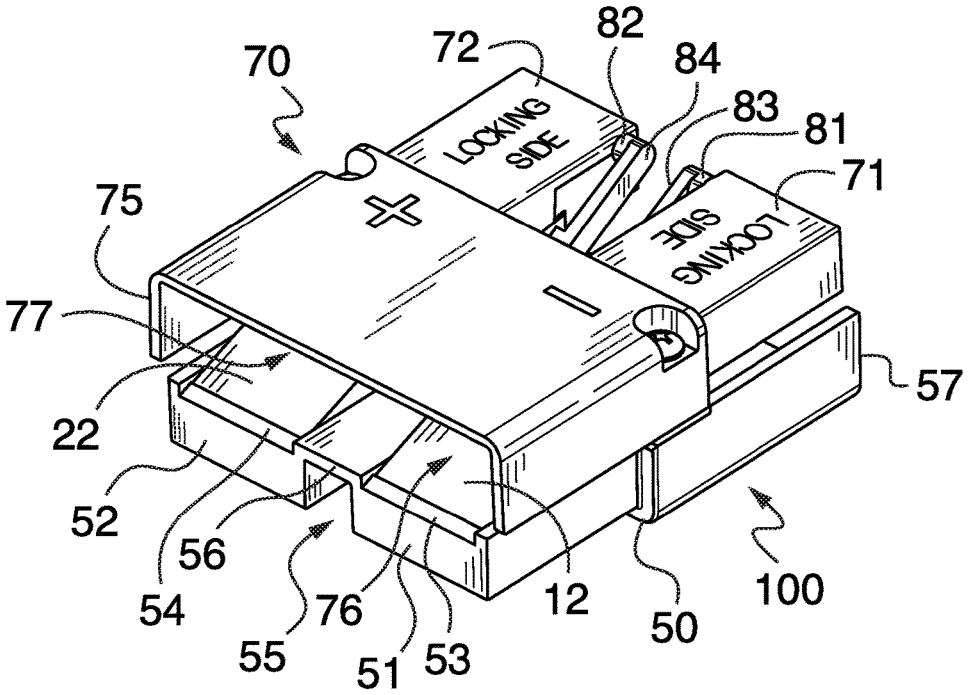

DURABLE INTERFACE FOR WIPING ELECTRICAL CONTACTS

BACKGROUND OF THE INVENTION

Field of the Invention

The present general inventive concept is directed to a durable low friction interface for connecting wiping electrical contacts, including genderless electrical connectors, in an adaptor plug or electrical power connector to extend the life of electrical contacts.

Description of the Related Art

Modular electrical connections for batteries are well known. A number of electrical connectors are currently sold. U.S. Pat. No. 3,259,878 to Winkler discloses a genderless electrical contact. U.S. Pat. No. 7,153,152 to Eby et al. discloses a genderless electrical contact with decreased contact bounce. The contacts on each side of the electrical connection present the same physical configuration with one side being rotated 180 degrees to present an inverted position. The electrical contacts have a sloping front side to guide the interfacing electrical connections to deflect in opposite directions, and are configured with a detent distal from the front side that retains the interfacing electrical contacts. Different electrical contact configurations provide a raised profile with an angled portion as shown in Eby or a convex portion as shown in Winkler. In either case the medial raised profile is located between the sloped front side and the detent. The electrical connection is maintained by friction and force from a leaf spring to bias the electrical contacts towards the center of the housing. The force required to make the connection increases as one contact is inserted against the other. The height of the medial section increases the movement off center and displacement of the contact against the leaf spring as one medial section displaces the other to offset the leaf spring from its resting position. As the medial sections move past each other, a position of maximum deflection is reached, after which deflection is reduced, spring force is reduced, and each medial portion engages a detent in the corresponding contact. This serves to retain the connection in a stable configuration. To disconnect the electrical connection, sufficient force must be applied to drag the medial sections across each other against the force of the leaf spring.

Insertion and removal of electrical contacts requires different amounts of force depending on the component composition and the configuration of the components to be connected. The coefficient of friction of the various material surfaces contributes to the force required for insertion. The normal force combines with the coefficient of friction to determine the friction force between two flat surfaces in contact. Additionally, the geometry of the components provides additional variation to the pressure angle and the required insertion force. Friction force, or resistance to motion, is the product of normal force and friction coefficient. Exemplary ranges include a static friction coefficient of 1.4 for silver on silver surfaces. Silver and copper provide an exemplary static friction coefficient of 1.0. Lubricated metal can be in the range of 0.55 friction coefficient. In contrast Teflon on Teflon provides a friction coefficient of 0.04. Additional considerations affect the required insertion force when the surfaces are not flat or parallel. The medial section of an electrical contact inserted against a threshold requires an insertion force that is determined by the friction coefficient and the geometry of the surfaces, for example a ramp angle, as well as the spring force and spring deflection. For an electrical contact supported by a leaf spring, the amount of force required to make the connection is increased by increasing the total deflection as well as the angle of a threshold interface, the spring force, and the friction coefficient between the surfaces. When two convex surfaces interface, the friction force further increases. For all other conditions being held equal, reducing the coefficient of friction reduces the friction force and makes the connection easier to accomplish.

Metal on metal contact can create adhesion where microscopic peaks of the mating materials weld together and material transfer occurs when materials slide relative to each other. Material transfer can occur known as galling. Like metals dragging against each other exhibit galling more often than dissimilar materials. Galling can more quickly alter the surface of a material than frictional wear that affects surfaces in a manner similar to sanding or filing.

Wiping electrical contacts are known and widely used. The connect and disconnect cycles are sometimes performed while under load, or hot mating, so the arcing can have destructive effects on the metal surface of the contacts. This is important as the quality of the connection is dependent on the proper geometry of the electrical contacts as they engage and disengage each other. As the surface is worn, the geometry of the connection is altered. A persistent problem with the devices in current use is that the surface of the electrical contact degrades over time with numerous repeated forced connect disconnect cycles. The quality of the mechanical and electrical connection is degraded, leading to increased resistance and increased heating of the connection housing. Eventually, the electrical contacts, or the entire connector, requires replacement. Replacement is difficult and time consuming. Typically the user becomes aware of a faulty connection, or the connection fails, when the power source is being connected or disconnected and the user is not in an ideal location to repair or replace the connection interface.

Genderless electrical contacts are suited for ease of connect-disconnect use. One widespread use of the flat wiping contacts is to connect batteries on equipment including lift trucks. When a battery is discharged, it can be disconnected from the application or equipment and connected to a charging device.

The prior art devices rely on a leaf spring to bias the connector towards the center of the housing. When two convex contacts are wiped against each other, the size of the convex bulge of the medial section determines the displacement of the connectors and leaf springs required to make the connection. Utilizing a convex contact of a higher size requires increased displacement, and therefore more force to make the connection and remove the connection. Convex contacts having a larger bulge are known as high detent contacts. Convex contacts having a smaller bulge are known as low detent contacts. The increased force required to achieve connect disconnect cycles with existing metal on metal friction can be inconvenient to users. While there are advantages to flat wiping electrical contacts, including that the flat wiping of contacts against each other serves to clean or remove debris, the resulting friction causes the degradation of the contacts and requires eventual replacement.

What is needed is an electrical connector with a durable low friction threshold that can increase the longevity of electrical contacts while utilizing leaf spring deflection in existing electrical contacts for flat wiping connect disconnect cycles.

SUMMARY OF THE INVENTION

It is an aspect of the present invention to provide a durable low friction threshold for use in electrical connectors and an electrical connector comprising at least one low friction threshold. A connection device that provides reduced friction force can provide reduced wear on electrical contacts with continued use. Reduced friction force can increase the longevity of electrical contacts and electrical connectors by reducing frictional wear and material transfer due to galling. What is needed is a device that provides reduced friction force in a connect disconnect cycle while providing the structure to establish a durable electrical connection.

The above aspects can be obtained by a terminal plug for electrical connection defined by a housing and at least one ramp interface having a ramp surface, a ramp apex and a ramp recess to receive a lug and form a detent between the lug and the ramp apex, the detent suited for retaining an electrical contact in stable electrical contact with the lug. An additional ramp interface and lug can be provided in the housing to form a dipole terminal plug. The ramp interface can be non-conductive to delay electrical connection between an electrical contact and the lug.

Another aspect of the invention provides a coupling suited for connection on both sides. The coupling provides a low friction ramp interface on a first side for durable electrical connection. A second side of the coupling can provide a conventional connection, a second ramp interface, or a threshold interface with an optional locking mechanism to provide a coupling that is more durably connected on a second side while providing for repeated connection on a first side. An aspect of the invention is to provide interference between an inserted electrical contact and conductive elements in the coupling to delay initial conductive contact until a medial section of an electrical contact passes a threshold interface comprising a ramp interface or a step interface as described herein. A ramp surface or step apex can deflect an inserted electrical contact in a low friction surface interface to achieve deflection while avoiding scraping of metal upon metal and reducing the forces needed to make mechanical and electrical connections.

Another aspect of the invention is to provide a ramp interface comprising a leading face to accomplish a wiping action against an inserted electrical contact to remove debris and establish a clean electrical connection. The various embodiments presented can all provide delayed electrical connection of a contact by interference of a ramp surface, and where the ramp surface comprises a low friction coefficient, a device of the invention provides increased durability, longevity, and ease of use.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which:

FIG. 3 is a side view of electrical contacts.

FIG. 4A is a front perspective view of a coupling in an embodiment of the invention.

DESCRIPTION OF THE PREFERRED EMBODIMENTS

Figure 1:
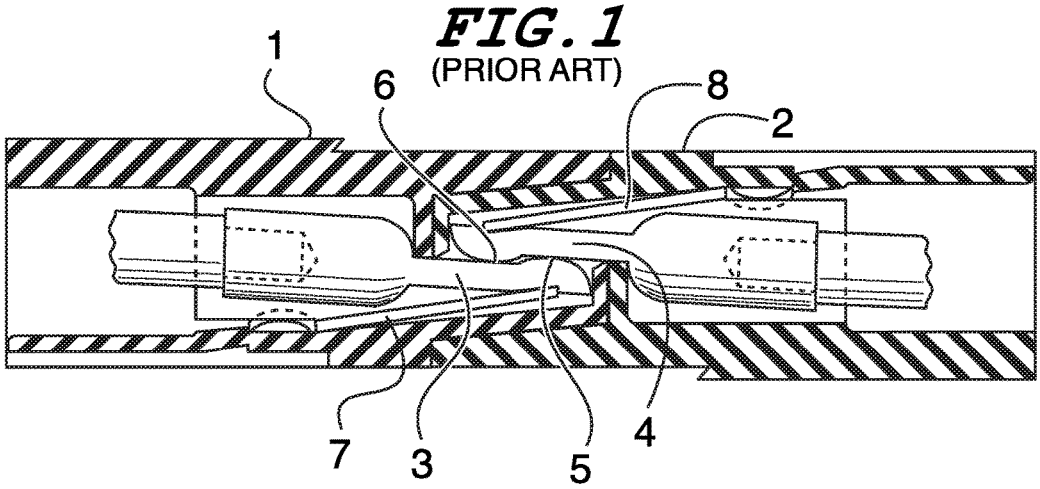
FIG. 1 (PRIOR ART)
FIG. 1 is a side view of a prior art electrical connection.

Reference will now be made in detail to the presently preferred embodiments of the invention, examples of which are illustrated in the accompanying drawings, wherein like reference numerals refer to like elements throughout.

The present inventive concept relates to a low friction interface for connecting a genderless electrical contact and an embodiment of a coupling providing at least one low friction interface. The present invention comprises an embodiment for accepting a genderless connector that reduces the metal to metal contact by presenting an interface step or interface ramp anterior to an electrical conduit. In the prior art, two connectors are contained in housings and pushed together to create a friction fit. Each is biased towards the center of the housing by a leaf spring. The result is a friction connection and a friction fit. It is an object of the invention to provide the same durable electrical connection while alleviating the friction and friction force during a substantial portion of the insertion of the electrical connection. The final resting point of the inserted contact should retain friction force and pressure to maintain a stable electrical connection, however the path of the electrical contact can be altered so that a significant portion of the insertion and removal presents a low friction interface so that wear is reduced and the force required to utilize the device is also reduced. Additional embodiments of the invention provide a terminal plug with a low friction interface and a coupling with a low friction interface.

FIG. 1 shows a prior art telescoped housing connection with two flat wiping electrical contacts. The subject matter is disclosed in U.S. Pat. No. 3,259,870 to Winkler. First connection housing 1 is connected to second connection housing 2 in telescoping arrangement. Housing 1 and 2 on each side of the drawing are the same configuration with one side rotated by 180 degrees so that the housings 1 and 2 telescope and first contact 3 and second contact 4 are joined by friction fit. Leaf springs 7, 8 bias the contacts towards the center of housings 1, 2. First medial section 5 and second medial section 6 have been inserted into the opposite housing across the corresponding medial section of the other contact.

This method of electrical connection has been successful and widely implemented along with numerous subsequent modifications. One of the problems with friction fit electrical contacts is that numerous connect disconnect cycles degrade the surface of the contacts. Galling can occur. A first contact is scraped over the surface of the second contact to overcome the tension of the leaf spring. When electrical connections are made to live electrical contacts, hot mating, arcing can combine with friction to damage the contact surface.

Figure 2:
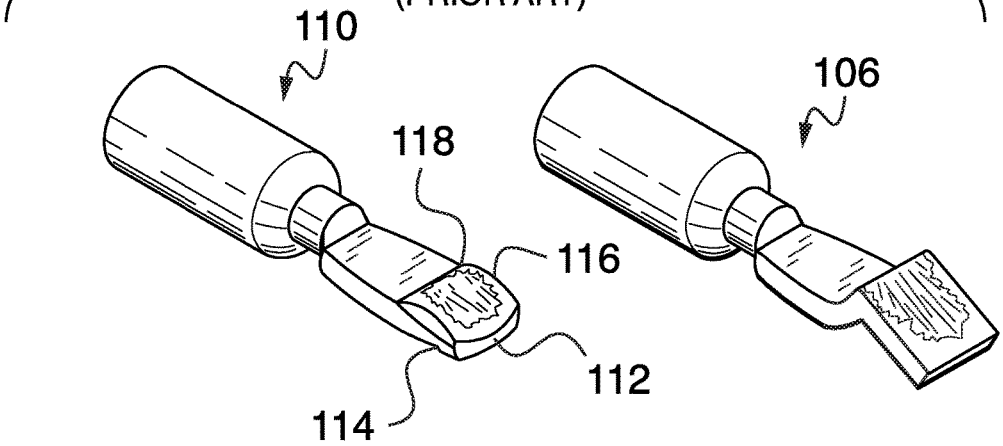
FIG. 2 (PRIOR ART)
FIG. 2 is a top view of degraded electrical contacts.

FIG. 2 shows a perspective view of electrical contacts that have been moderately or severely degraded over numerous connect disconnect cycles, i.e. normal use. An arcuate connector is shown as a high detent contact 110 with medial section 116 providing an offset bulge between front edge 112 and detent 118. Spring hook 114 is configured to retain a leaf spring (not shown) or other retaining feature. Planar connector 106 is shown as an alternative configuration.

FIG. 3 presents a side view of arcuate high detent and low detent electrical contacts. Medial section 116 provides the offset movement upon insertion of the high detent contact 110. Medial section height 111 can be about $1/16^{th}$ of an inch. Low detent configurations can be utilized as in low detent contact 120 where medial section height 121 can be about $1/32^{nd}$ of an inch. Front edge 122, spring hook 124, medial section 126 and detent 128 are shown. Medial section height 111 dictates the amount of deflection from resting configuration required to achieve insertion of the contact 110 across a similarly configured contact to achieve a tensioned connection. The deflection of the contact increases as the contact is inserted, and the maximum deflection, caused by the medial section height, causes offset movement of the leaf spring and increases the forces of the contacts against each other and the friction force of the contacts against each other. As the medial section of one contact passes the center of the other medial section, the friction is reduced, the leaf spring offset is reduced, and the contacts snap into place. When connected, the medial section of each contact rests in the detent of the opposite contact.

As discussed above, the friction of one contact against another results in degradation of the contact surface. An embodiment of the invention provides an interface that engages an inserted electrical contact and delays metal on metal contact until the electrical contact is at least partially inserted. An embodiment of the invention comprising a coupling with a ramp threshold and a step threshold is provided and presented in various views in FIGS. 4A through 4E. Embodiments comprising a ramp threshold on one side of the connector, or a step threshold on one side of the connector, or ramp thresholds on each side of the connector, or step thresholds on each side of the connector, are contemplated in the spirit of the invention. Exemplary illustrations are included showing some of the available contemplated combinations.

FIG. 4A is a front perspective view of a coupling in an embodiment of the invention. A dipole connector is shown suited for connecting pairs of electrical contacts, and the inventive concept is applicable to a monopole connector suitable for connecting a single pair of contacts. The inventive concept is also scalable to three or more pairs of electrical contacts in situations where a positive, negative, and ground contact are appropriate, or multiple electrical contacts are needed to provide current or electrical signals. Monopole and tripole couplings can be provided in the spirit of the invention. Coupling 100 of FIG. 4A provides an interface in front of a bus bar so that insertion of a conventional electrical contact with an electrical contacting engaging surface first engages the low friction interface before making physical and electrical contact with an electrical conduit. An inserted contact first engages a non-conductive structure to establish at least some of the offset movement of the contact prior to making electrical and physical contact with a conductive material.

Housing top 70 provides an exterior structure and is made of nonconductive material. Housing bottom 50 completes the exterior of the coupling and is also preferably composed of nonconductive material. First front channel 51 is connected to second front channel 52 by guide bridge 56 which together define guide recess 55. Guide recess 55 is suited for receiving, for example, a central guide 144 shown in FIG. 5. First channel ramp 53 is angled and is positioned adjacent first ramp surface 12. Second channel ramp 54 is angled and is positioned adjacent second ramp surface 22. Front shroud 75 defines openings above the ramp surfaces in the front side of housing top 70. The space between first ramp surface 12 and front shroud 75 provides first front passage 76 and the space between second ramp surface 22 and front shroud 75 provides second front passage 77.

The rear side of housing top 70 comprises first rear channel guide 71 and second rear channel guide 72. First cantilever pivot 81 provides for rotational movement of first cantilever arm 83 and second cantilever pivot 82 provides for rotational movement of second cantilever arm 84. Housing bottom 50 comprises rear shroud 57. First cantilever pivot 81 and first cantilever arm 83 combine to act as spring elements and allow incline hook not shown to be forced downward by contact with a plug wall structure not shown or when pressed by a user.

Figure 4B:
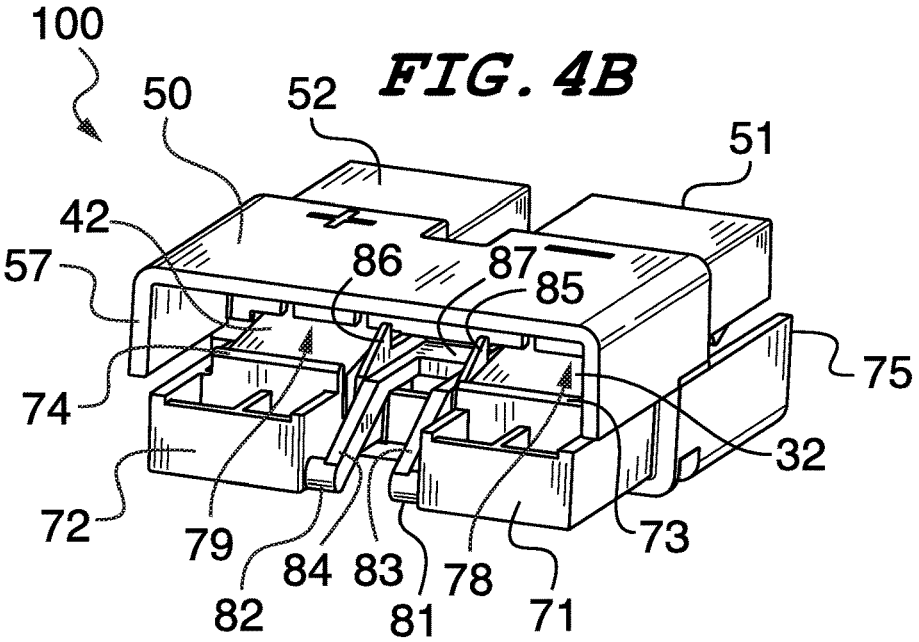
FIG. 4B is a rear perspective view of a coupling in an embodiment of the invention.

FIG. 4B is a rear perspective view of a coupling in an embodiment of the invention. First step interface 73 is shown adjacent second surface 32 of first electrical conduit 30 (not numbered). Second step interface 74 is shown adjacent second surface 42 of second electrical conduit 40 (not numbered). The space between first step interface 73 and rear shroud 57 provides first rear passage 78 and the space between second step interface 74 and rear shroud 57 provides second rear passage 79. First incline hook 85 and second incline hook 86 are disposed on first torsion arm 83 and second torsion arm 84, respectively, and connected to move in tandem by lock bridge 87. The presence of first incline hook 85 and second incline hook 86 combine to form a locking mechanism feature to more securely retain the connection on one side of the coupling 100. Various embodiments can be provided where both the front side and rear side of the coupling provide a ramp interface comprising a ramp surface such as first ramp surface 12. In an additional embodiment, both sides of the coupling can be provided with a step interface such as first step interface 73. The ramp interface configuration provides for an easier insertion and removal of a contact than the step interface. In an embodiment of the invention both a step interface and a ramp interface can be provided on opposite sides of a coupling to provide for one side of the coupling to remain connected while the other side is utilized for routine connect disconnect use. The configuration containing the step interface can provide an increased pressure angle as desired to require an increased insertion force dictated by the friction coefficient and the total deflection. Either the step interface or the ramp interface can be combined with a locking mechanism to more securely retain coupling 100. In an embodiment, a step interface is shown in combination with a lock to provide a locking side of the coupling, shown in FIG. 4B as the rear side of the coupling. Various locking mechanisms can be employed. In an embodiment of the invention, a torsion arm is provided as shown in FIG. 4B.

Figure 4C:
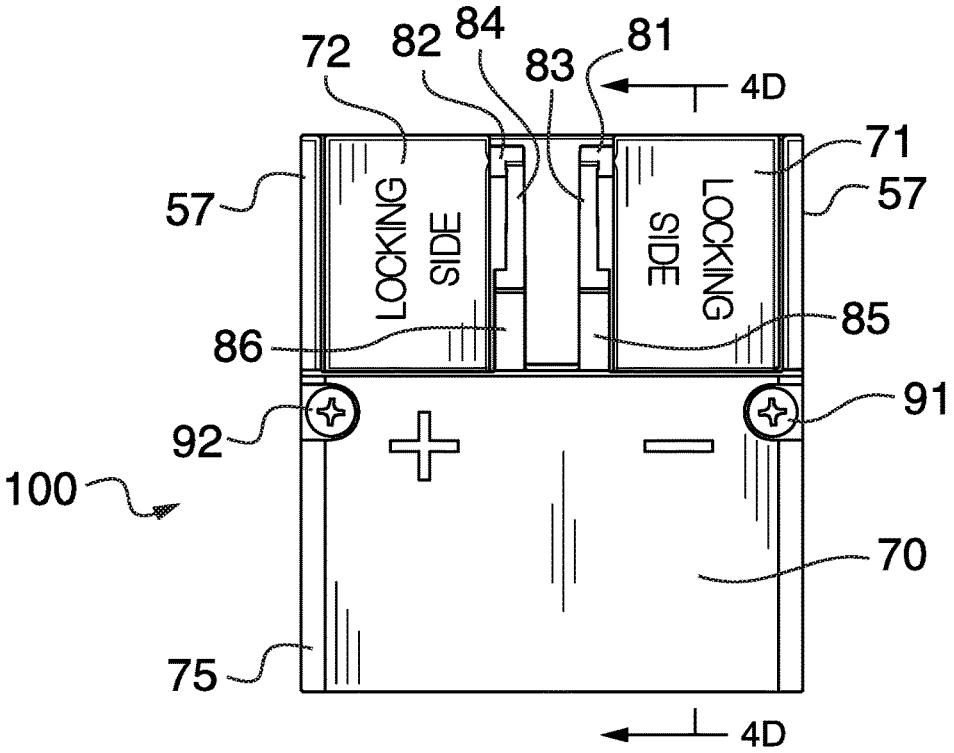
FIG. 4C is a top view of a coupling in an embodiment of the invention.

FIG. 4C is a top view of a coupling in an embodiment of the invention. Housing top 70 is presented with front shroud 75. First rear channel guide 71 and second rear channel guide 72 are spaced apart and connected to first cantilever pivot 81 and second cantilever pivot 82 respectively. Rear shroud 57 is visible on the outboard sides of channel guides 71 and 72.

Figure 4D:
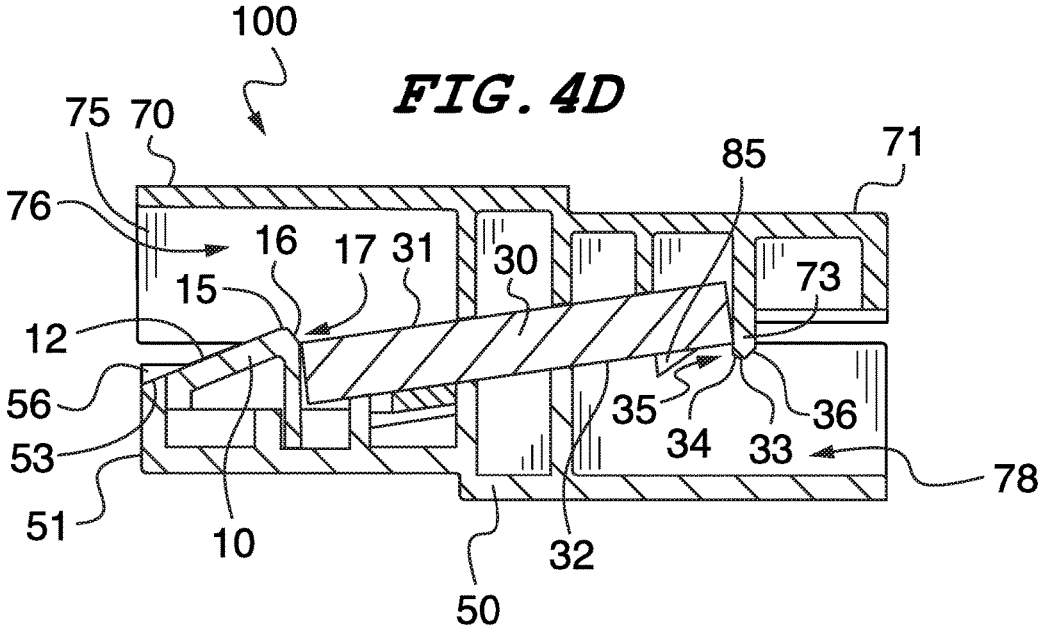
FIG. 4D is a sectional view of a coupling in an embodiment of the invention.

FIG. 4D is a sectional view of a coupling 100 in an embodiment of the invention along section line 4D shown in FIG. 4C. First electrical conduit 30 is shown between first ramp interface 10 and first step interface 73. First surface 31 is exposed for contact with an electrical connector such as contact 110 in FIG. 3. First ramp interface 10 provides first ramp surface 12 aligned with first channel ramp 53 to provide for a smooth insertion of an electrical contact into first front passage 76. In place of a conventional inverted electrical contact, inserted contact 110 is guided by first channel ramp 53 to engage first ramp surface 12. Continued insertion of the contact 110 against first ramp surface 12 deflects the contact 110 an increasing amount as insertion progresses, and where ramp surface 12 is made of polymer or plastic with a low friction coefficient, insertion of contact 110 requires less force than conventional inverted electrical connectors. Teflon is one of many suitable materials with a low friction coefficient. First ramp interface 10 interferes with initial electrical connection of an inserted electrical contact. Upon passing first ramp apex 15, medial section 116 curvature causes untensioning of a leaf spring as medial section 116 moves down first ramp descent 16 and becomes retained in the area of first ramp detent 17. In this way, the detent between the angled surfaces of first surface 31 and first ramp descent 16 provides a resting position where movement further into first front passage 76 would increase deflection of the contact 110 and movement out of first front passage 76 would also increase deflection of the contact 110. The contact 110 is retained in physical connection with first surface 31 of first electrical conduit 30 to maintain stable electrical connection. A leaf spring such as leaf spring 7 shown in FIG. 1 maintains pressure of the electrical contact and forces medial section 116 into electrical conduit 30. Removal of electrical contact 110 from first front passage 76 requires deflection of the contact approximate the medial section height 111 and a comparable amount of deflection of the leaf spring. This requires force to achieve that can be provided by hand strength, but will retain the electrical and physical connection under normal operating conditions including vibration. The slope of first ramp descent 16 can be increased or decreased to cause greater deflection per unit travel and therefore determine the ease or difficulty with which an electrical contact can be removed from the area of first ramp detent 17. The height of first ramp apex 15 from first ramp detent 17 can be approximated to medial section height 111 of 1/16 inch in high detent contacts and medial section height 121 of 1/32 inch in low detent contacts, for example. A range of 0.02 to 0.04 inches for first ramp apex 15 height above adjacent first ramp detent 17 allows a medial section 116 or medial section 126 to contact conduit 30 without diminishing the contact force provided by a leaf spring, not shown. An embodiment of the invention provides a height of 0.036 inches for first ramp apex 15. A ramp apex 15 height of at least 0.02 inches provides sufficient height to retain a contact 110 in place and requires increased deflection of 0.02 inches against a tensioned leaf spring to remove the contact from ramp detent 17.

It is expected that an inserted electrical contact will engage the channel ramp if not inserted exactly parallel to front passage 76. Upon horizontal travel, an electrical contact will engage, for example, first ramp surface 12 to provide deflection of the contact against a leaf spring and tension the connector. In an embodiment suited for use with an existing electrical contact 110, insertion of the contact 110 by approximately 0.5 inches into the coupling 100 clears first ramp apex 15 so that medial section 116 rests in first ramp detent 17. First ramp detent 17 is the general area shaped like a valley in cross section with first ramp apex 15 on one side and the slope of conduit first surface 31 on the other side. The detent serves to retain a medial section 116 of an electrical contact that will contact a first surface 31 about one to three thousandths of an inch past descent 16. Deflection is caused by insertion against first ramp surface 12, and not all of the deflection, and tension, are relieved by clearance of first ramp apex 15. Deflection of 0.02 inches, for example, can be maintained by a conduit. While the medial section 116 rests in first ramp detent 17, leaf spring is still deflected by an amount sufficient to tension the contact against first surface 31 of electrical conduit 30. Experimentation has determined that deflection of 0.08 to 0.11 inches at the detent position is sufficient to maintain a stable electrical connection against factors such as movement and vibration. In one particular embodiment, electrical connection is delayed for 0.55 inches of contact insertion and deflection of 0.180 inches is achieved by first ramp apex 15 against a medial section 116 of a contact 110 before electrical connection is established.

On the rear side of the coupling in an embodiment of the invention, first rear passage 78 is shown between housing bottom 50 and first rear channel guide 71. Insertion of an electrical contact, whether arcuate or planar or other configuration will encounter first step interface 73 having first step ascent 36, first step apex 33, first step descent 34 and first step detent 35 area adjacent second surface 32 of first electrical conduit 30. Insertion of a conventional electrical flat wiping contact or other configured contact such as contact 4 of FIG. 1 with medial section 6 will cause leaf spring 8 to deflect to accommodate the medial section height. Taking for example low detent contact 120 of FIG. 3, a leaf spring would be moved to accommodate medial section height 121. Upon movement of medial section 126 past first step apex 33, deflection is reduced and the medial section resides in first step detent 35. First step interface 73 is preferably non-conductive. The geometric configuration can be designed to provide the appropriate amount of retention of an electrical contact. For example, first step descent 34 is shown as vertical and perpendicular to the direction of travel of the electrical contact. This serves to retain the contact. The height of first step apex 33 above first step detent 35 also serves to retain the contact, and a height of 0.03 inches to 0.04 inches can retain high and low detent contacts. A minimum height of 0.02 inches retains an inserted contact having a low detent medial section 126 shown in FIG. 3.

The slope for first step ascent 36 and first step descent 34 can be in a range of 20°-60°. In an embodiment, first step ascent 36 is provided with a slope of 45° and first step descent is provided with a slope of 35° from horizontal. The range of height from first step apex 33 to first step detent 35 area can be provided as 0.020 to 0.040 inches to retain exemplary electrical contact 120 with medial height 121 of $1/32^{nd}$ of an inch. It is desirable to maintain tension between the inserted contact (not shown) and the conduit 30 to maintain a consistent electrical and physical connection.

Figure 4E:
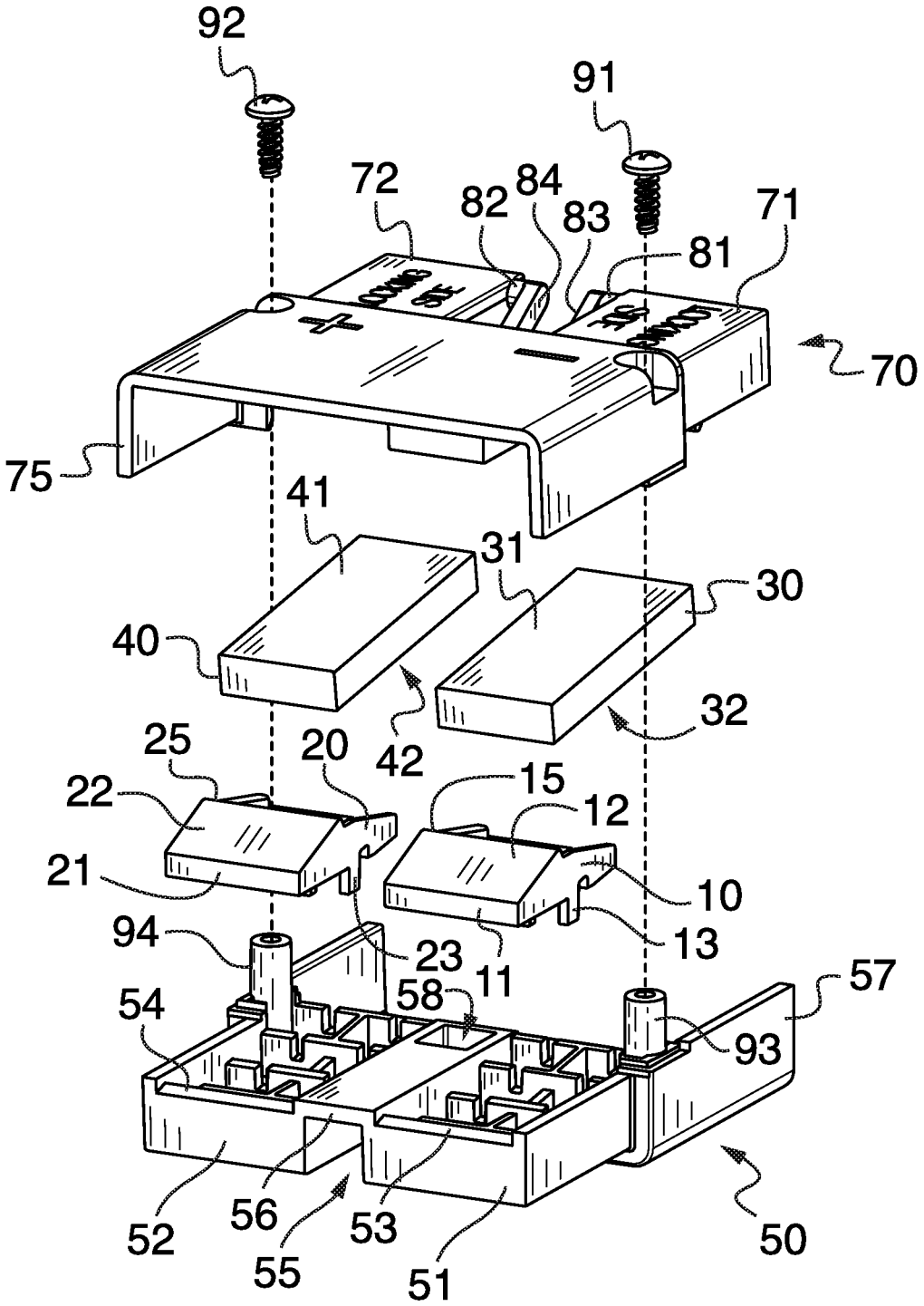
FIG. 4E is an exploded view of a coupling in an embodiment of the invention.

FIG. 4E is an exploded view of a coupling in an embodiment of the invention. Housing top 70 can be made of molded plastic. First electrical conduit 30 is shown with first surface 31 and second surface 32. Second electrical conduit 40 is shown with first surface 41 and second surface 42. First ramp interface 10 provides a low friction threshold for insertion of an electrical contact. First ramp interface 10 can be made of plastic or other material that is durable such as polyamide, nylon, acetal, polytetrafluoroethylene (PTFE), or ultra high molecular weight polyethylene. These materials provide a low friction coefficient against metals including silver and copper. It is desirable to provide a ramp interface, or step interface, material with a friction coefficient against silver of 0.3 or less. Retaining post 13 retains the position of first ramp interface 10 when inserted into housing bottom 50. First ramp front edge 11 rests against the interior of housing bottom 50 and further retains the position of first ramp interface 10. First ramp surface 12 provides for deflection of an electrical contact dependent on the slope of the ramp surface. By having slope of 15 to 60 degrees, the deflection of an electrical contact per unit travel upon insertion can be determined. In the embodiment shown in FIG. 4D, the angle of inclination of first ramp surface 12 is approximately 20 degrees. Geometry dictates that for each inch of travel across first ramp surface 12, horizontal travel is 0.94 inches and vertical travel is 0.34 inches. Vertical travel causes offset movement of the contact against a leaf spring. Greater slope of ramp surface 12 results in greater offset movement per unit travel. Increasing the slope increases the rate of leaf spring movement per unit travel. Having a lower slope eases insertion while having a higher slope increases the force required for insertion. The position and height of first ramp apex 15 determines the maximum deflection of an electrical contact upon insertion. In a dipole coupling, second ramp interface 20 provides similar features and provides a low friction ramp for deflection of an inserted electrical contact and retains the position of a contact after insertion. The baffled structure of housing bottom 50 provides for heat transfer to address the heat created by high current connections. In a particular embodiment, a ramp interface is provided having a ramp surface with a length of 0.482 inches and a horizontal length of 0.452 inches and a ramp height rise of 0.168 inches to provide a ramp slope of about 20 degrees from horizontal; first ramp front edge 11 has a height of 0.132 inches and a width of 0.866 inches.

Retaining post 23 maintains the position of second ramp interface 20. Second ramp front edge 21 further retains the position of second ramp interface 20. Second ramp surface 22 provides for progressive deflection of an electrical contact upon insertion. Second ramp apex 25 determines the maximum deflection of an electrical contact upon insertion. First fastener 91 attaches housing top 70 to housing bottom 50 by threaded attachment into first attachment post 93. Second fastener 92 can also be employed to attach housing top 70 to housing bottom 50 by threaded engagement with second attachment post 94. Other attachment means can be employed and the housing top 70 and housing bottom 50 can be formed as a unitary piece or permanently joined together without the need for fasteners. Lock access 58 is shown as an opening in housing bottom 50 and provides access to lock bridge 87 in FIG. 4B. Pressing lock bridge 87 can move first incline hook 85 and second incline hook 86 to release the locking mechanism.

Figure 5:
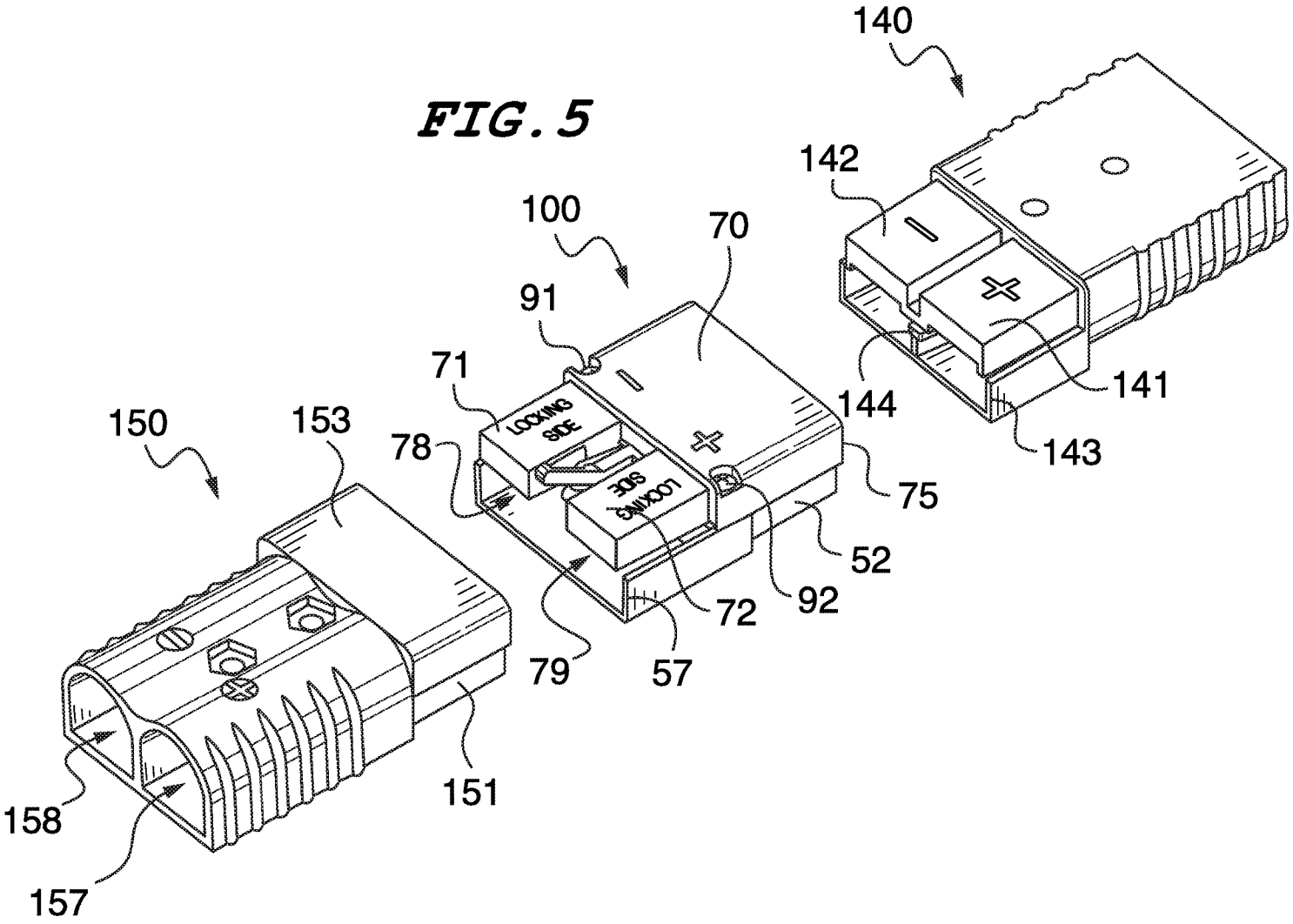
FIG. 5 is a perspective view of a coupling in an embodiment of the invention between two conventional genderless connectors.

FIG. 5 is a perspective view of a coupling in an embodiment of the invention between two conventional genderless connectors. This embodiment of the low friction interface connector is coupling 100 suited for connection with a first connector 140 and a second connector 150. Second connector 150 is aligned for insertion with the locking side of coupling 100 and shroud 153 is suited for insertion over first rear channel guide 71 and second rear channel guide 72. Rear shroud 57 is suited for insertion over channel guide 151. First connector 140 comprises channel guide 141 and channel guide 142 and shroud 143. Central guide 144 is centrally positioned and is suited for insertion to guide recess 55, not shown.

Figure 6:
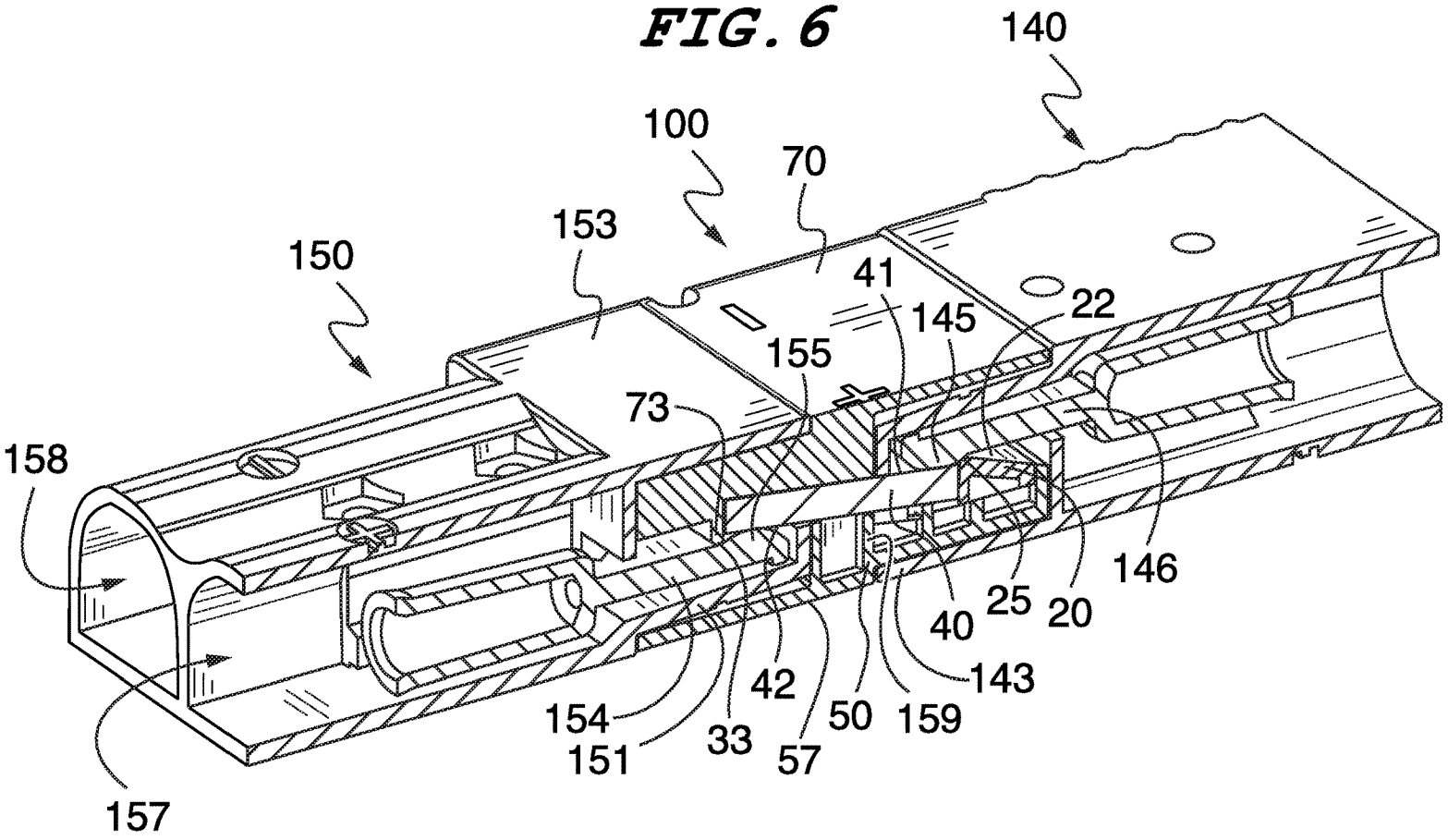
FIG. 6 is a sectional view of a coupling in an embodiment of the invention connecting two conventional genderless connectors.

FIG. 6 is a sectional view of a coupling in an embodiment of the invention connected to two conventional genderless connectors. First connector 140 comprises electrical contact 146 having medial section 145. Second connector 150 comprises electrical contact 154 comprising medial section 155. Upon insertion of first connector 140 into coupling 100, medial section 145 can be shown having cleared second ramp apex 25 of second ramp interface 20 and resting on first surface 41 of second electrical conduit 40. Upon insertion of second connector 150, medial section 155 of electrical contact 154 can be seen resting on second surface 42 of second electrical conduit 40. It will be appreciated that durable electrical connection of contacts 146 and 154 can be achieved with the hollow distal sides spaced apart from the coupling, by utilizing crimp barrels or other means known in the art. The inclined housing lock shown in FIG. 4B is engaged by connector front wall 159. Connector front wall 159 is presented as a vertical structure, shown in cross section. Connector front wall 159 upon insertion engages first incline hook 85 and second incline hook 86 to push first torsion arm 83 and second torsion arm 84 downward as enabled by first cantilever pivot 81 and second cantilever pivot 82. After connector front wall 159 clears the end of the incline hooks 85 and 86, the torsion arms move upward and the vertical portions of first incline hook 85 and second incline hook 86 prevent removal of connector front wall 159. Lock access 58 shown in FIG. 4E allows a user to press lock bridge 87 and clear incline hooks 85 and 86 from the path of connector front wall 159 to allow removal of second connector 150 shown in FIG. 6. First cable channel 157 and second cable channel 158 provide for spaced apart electrical cables.

Figure 7A:
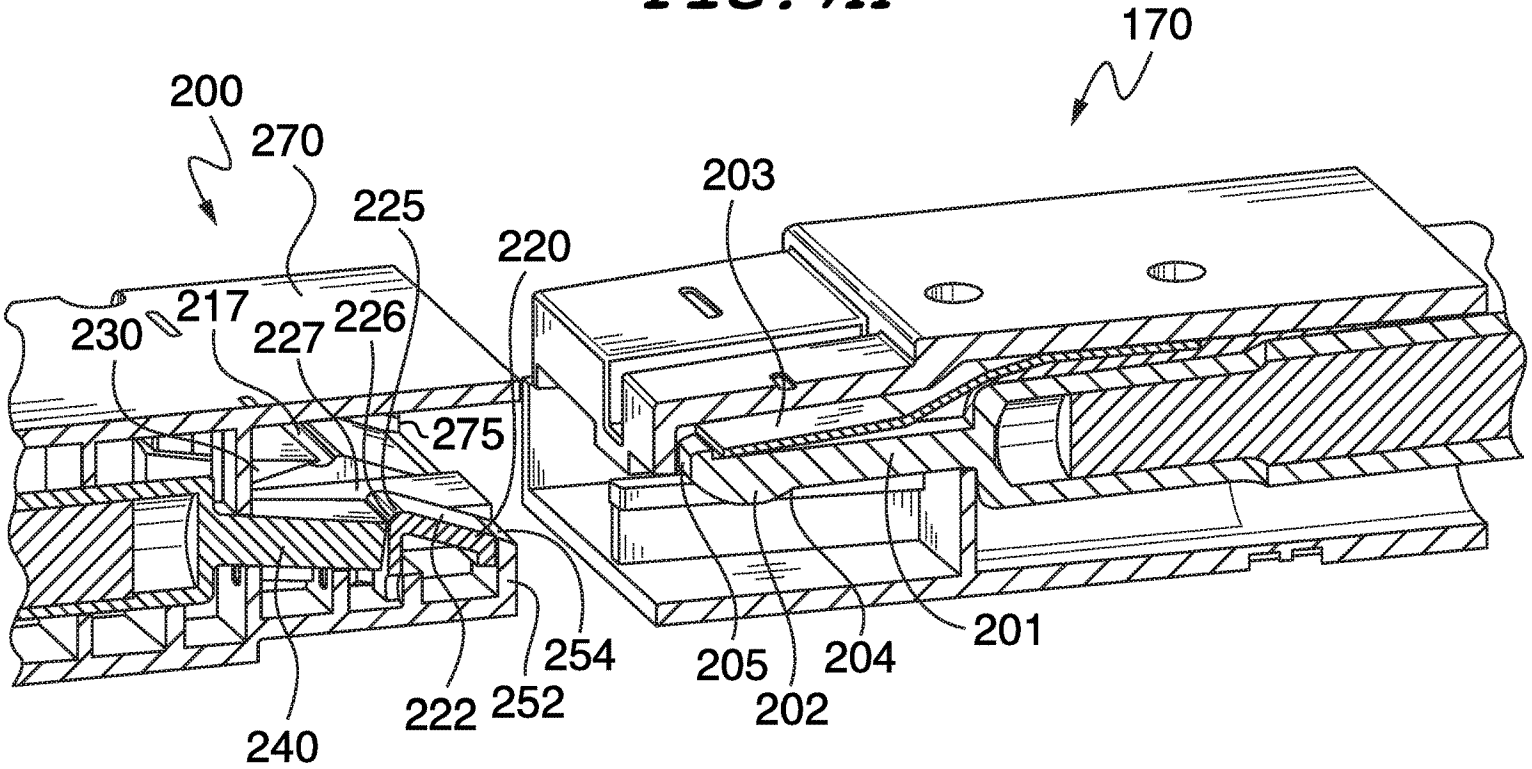
FIG. 7A is a sectional view of a terminal plug in an embodiment of the invention and a conventional genderless connection.

FIG. 7A presents a sectional view of a terminal plug comprising a low friction threshold in an embodiment of the invention positioned for connection with a conventional electrical connector. Terminal plug 200 is positioned for insertion with connector 170. Electrical contact 201 comprising medial section 202 and detent 204 is held in place by leaf spring 203. Front end 205 can be configured as flat, or rounded, or sloped. Upon insertion of connector 170 into terminal plug 200, medial section 202 is deflected by the second ramp surface 222 of second ramp interface 220. Second channel ramp 254 can have a slope corresponding to the slope of second ramp surface 222 for ease of insertion of electrical contact 201. A corresponding slope will be understood as being between parallel slope and a slope differing by up to 45 degrees. Thus a ramp surface 222 having a slope of 30 degrees and a channel ramp 254 having a slope of 75 degrees would be corresponding and in the same general direction. A slope difference of 90 degrees or more could obstruct insertion. Central guide 244 centers connector 170 with terminal plug 200.

Figure 7B:
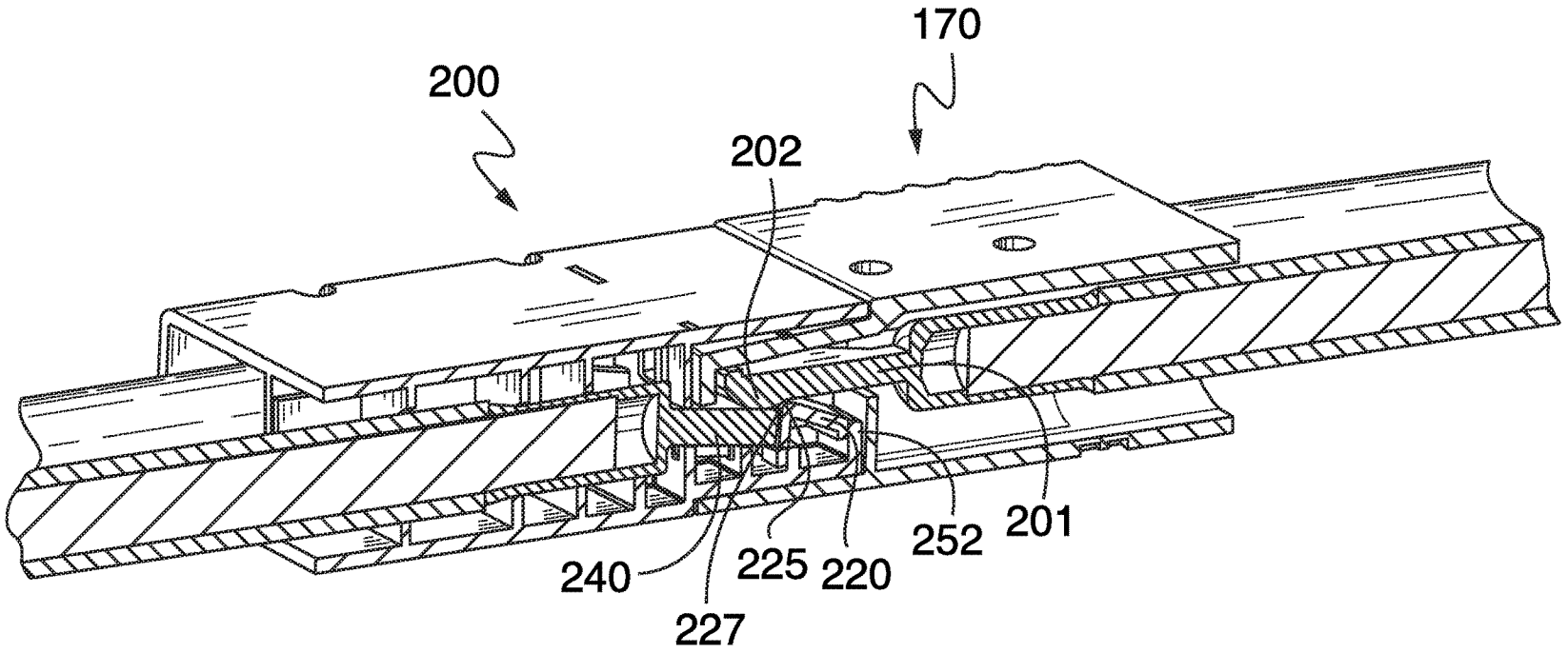
FIG. 7B is a sectional view of a terminal plug in an embodiment of the invention connected to a conventional genderless connection.

As electrical contact 201 is further inserted, deflection is increased until medial section 202 reaches second ramp apex 225. Upon passing second ramp apex 225, deflection is reduced, and the force provided by leaf spring 203 is reduced and the contact 201 is retained at rest in a stable configuration against second lug 240 in second ramp detent 227. Contact 201 rests against second lug ramp 241 shown in FIG. 8. Second lug ramp 241 is configured to maintain deflection of contact 201 when inserted to maintain tension force of the contact against the ramp for stable connection. Experimentation has determined that 0.01 inches provides some retaining tension and defection of contact 201 of 0.02 inches or more by second lug ramp 241 provides retaining tension sufficient to maintain connection during vibration and motion encountered in common applications. A first ramp apex 215 extending at least 0.01 inches above the immediate adjacent surface of first lug ramp 231 creates a first ramp detent 217 suitable for retaining an electrical contact. The inserted contact is shown in FIG. 7B. It will be understood that in a dipole connector, a pair of lugs and electrical contacts can be connected in this manner by simultaneous insertion. First ramp detent 217 is configured to retain an additional electrical contact, not shown. Removal of connector 170 from terminal plug 200 requires sliding movement of medial section 202 against second ramp descent 226. The slope of second ramp descent 226 can be selected to require more or less disconnection force as needed in particular applications. First ramp interface 210 can be configured with the same features as second ramp interface 220 for use in dipole connections.

Figure 8:
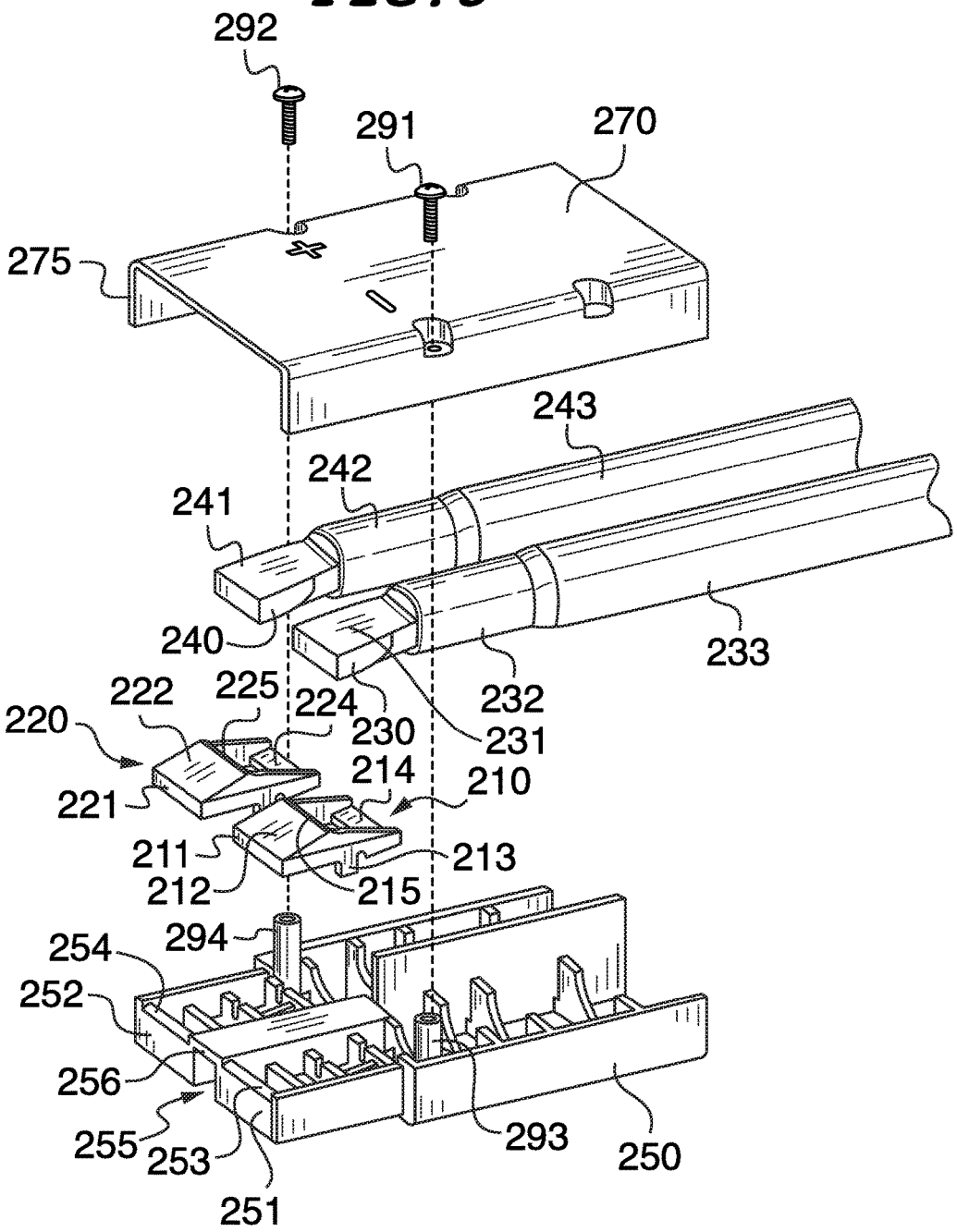
FIG. 8 is an exploded view of a terminal plug in an embodiment of the invention.

FIG. 8 presents an exploded view of a terminal plug in an embodiment of the invention. First fastener 291 can be used to connect housing top 270 to housing bottom 250 via first attachment post 293. Second fastener 292 can be used to connect housing top 270 to housing bottom 250 via second attachment post 294. First lug 230 comprises first lug ramp 231 and is connected to first lug crimp barrel 232 and first insulated conductor 233. Second lug 240 comprises second lug ramp 241 and is connected to second lug crimp barrel 242 and second insulated conductor 243. Front shroud 275 provides an outer boundary of the terminal plug, guides insertion, and prevents contact with electrical conduits first lug 230 and second lug 240.

First ramp interface 210 is shown with first ramp surface 212 positioned between first ramp front edge 211 and first ramp apex 215. First ramp bridge 214 provides stability to the structure of first ramp interface 210 and provides a resting position for first lug 230. First ramp recess, not numbered, is disposed between first ramp bridge 214 and first ramp apex 215 and provides for stable positioning of first lug 230 as shown in FIG. 7A. Retaining post 213 retains the position of first ramp interface 210 in housing bottom 250. Second ramp interface 220 is shown with second ramp surface 222 positioned between second ramp front edge 221 and second ramp apex 225. Second ramp bridge 224 provides stability to the structure of second ramp interface 220 and provides a resting position defining the bottom of second ramp recess, not numbered, for second lug 240. Second ramp interface comprises at least one retaining post, not shown, to retain the position of the insert in housing bottom 250. Housing bottom 250 comprises first front channel 251, second front channel 252, first channel ramp 253, second channel ramp 254, guide recess 255, and guide bridge 256. First channel ramp 253 can have a slope corresponding to the slope of first ramp surface 212 (within 45 degrees of each other) for ease of insertion of an electrical contact. Dimensions of a suitable ramp interface provide for ease of insertion of an electrical contact into the terminal plug. A slope of first ramp surface 212 can be between 8 and 63 degrees from horizontal to achieve deflection of an electrical contact upon insertion. A ramp surface having a run length of 0.1 inches to 1 inch and a rise height of 0.1 inches to 0.5 inches can provide a range of slopes for the ramp surface. Ramp interfaces are preferably provided with a run length of between 0.1 and 0.7 inches and a rise of 0.1 to 0.2 inches, however other ranges can be employed within the spirit of the invention and provide a durable, low friction threshold configured to interface with electrical contacts in the range of existing sizes and shapes. With a run length of 0.1 inches and a rise height of 0.2 inches, a slope of approximately 63 degrees is achieved. With a run length of 0.7 inches and a rise height of 0.1 inches, a slope of approximately 8 degrees is achieved. With a low friction material such as plastic, insertion and deflection of a metal electrical contact can be achieved with less force than required to insert two metal contacts against each other. It has been found that a slope range of 10 to 50 degrees provides ease of insertion with a range of 15 to 45 degrees being more amenable to ease of insertion by a user. Insertion of an electrical contact can be measured from the point an electrical contact 110 enters the housing of the coupling or terminal plug. Delay of metal to metal contact also delays electrical connection. One of the benefits of the invention is that the deflection of the electrical contact 110 is not achieved under load and so the scraping of the contact is not accompanied by arcing that can degrade the surface of the contact. The ramp interface can be composed of plastic while the lug can be composed of metal ensuring that initial insertion of an electrical contact does not provide immediate electrical connection, but that initial conductive contact is delayed until the contact is inserted, for example at least 0.25 inches into the terminal plug housing.

Ramp interfaces 210, 220 and 10, 20 as provided above can be made of injection molded materials including plastics such as nylon, or Teflon or other plastics. Nylon PA 6/6 or 66/6 are suitable materials for molding a ramp interface. These materials are not used in the conventional genderless contact where metal contacts are joined with corresponding metal contacts. Conduit 30 can be composed of conductive material, preferably metal and optionally plated with a second conductive metal. Metals can be selected from the group of silver, copper, gold, aluminum, brass, tin, nickel, zinc or iron. Alloys can be employed for conductive elements including phosphor bronze or beryllium copper. A combination of ramp interface made of nylon and an electrical contact made of silver plated copper has a friction coefficient of silver on nylon of approximately 0.1. Compared to a friction coefficient for silver on silver of 1.4, this provides a low friction interface that is durable and provides increased ease of operation as well as increased durability. Other plastics and polymers can be used that yield a friction coefficient against silver of 0.3 or less.

Figure 9:
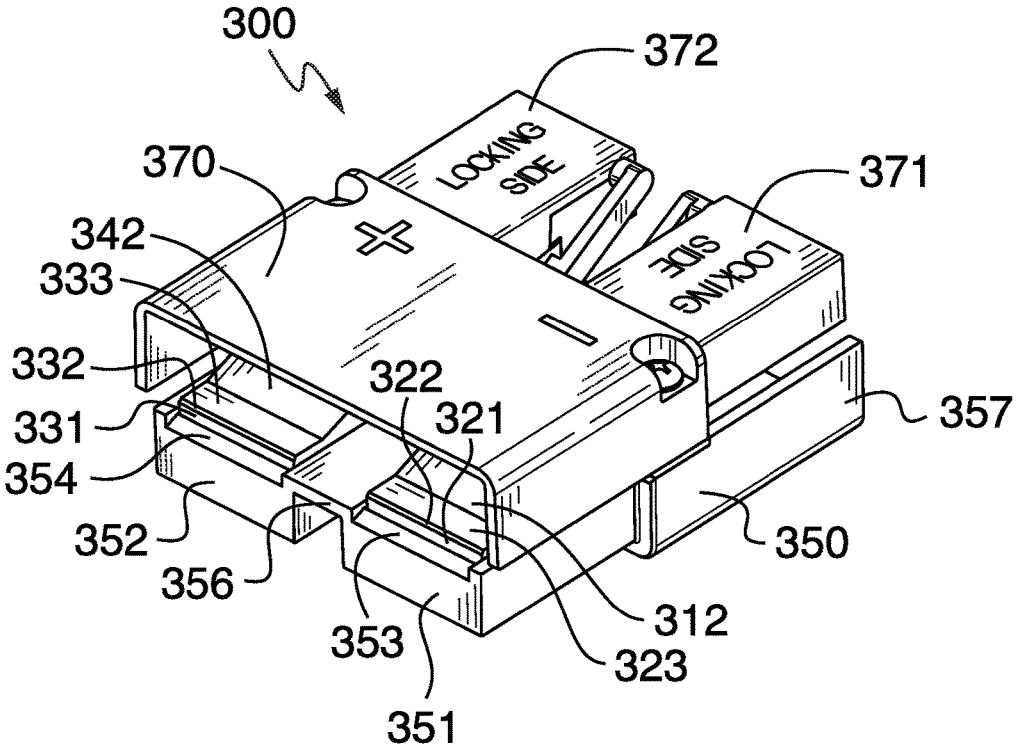
FIG. 9 is a perspective view of a coupling in an embodiment of the invention comprising a ramp interface with a leading face.

FIG. 9 presents a coupling in an embodiment of the invention comprising a wiping edge. In an additional embodiment suited for applications where debris or galling occur, a ramp interface can be provided with a wiping edge so that insertion of a wiping contact or genderless contact into a coupling can provide a scraping or wiping function to maintain and establish a clean electrical connection. Coupling 300 as shown in FIG. 9 is a dipole embodiment comprising a ramp interface with a first leading face 321 and a second leading face 331. Coupling 300 is shown comprising first front channel 351 and second front channel 352. First channel ramp 353 and second channel ramp 354 provide an angled surface to deflect an inserted electrical contact upwards. Guide bridge 356 connects two sides of the coupling 300.

First leading face 321 is substantially vertical and provides a scraping edge substantially normal to the surface of an inserted electrical contact, not shown. Substantially normal is within 15 degrees of normal to the electrical contact surface shown as, for example, medial section 126 of FIG. 3. First ramp shoulder 322 can be round or chamfer or right angle. Chamfer provides the advantage of being more durable than a right angle while providing a scraping edge to remove debris from the contact surface before encountering first ramp surface 312 or first ramp flat 323. The presence of first leading face 321 provides a high angle of attack so that any debris or galling on the contact is scraped off of the contact and the clean surface of the contact is deflected during insertion by first ramp surface 312. First ramp flat 323 allows for deflection and scraping of the contact by the leading face 321 and first ramp shoulder 322 for a duration of insertion. First ramp flat 323, being parallel to the direction of insertion, does not cause deflection of the electrical contact from resting position and allows deflection and scraping to be caused by the first leading face 321. After a substantial amount of insertion has been accomplished across first ramp flat 323, the electrical contact engages first ramp surface 312 to deflect an electrical contact anterior to a ramp apex as shown and described in FIGS. 4A through 4E.

Second leading face 331 is similarly situated at the other side of the dipole coupling 300. Second leading face 331 provides a scraping edge substantially normal to the surface of an inserted electrical contact, not shown. Substantially normal is within 15 degrees of normal to the electrical contact surface shown as, for example, medial section 126 of FIG. 3. Second ramp shoulder 332 can be a chamfer or other configuration that avoids the thinness of molded plastic in a right angle corner. A chamfer or corner provides a scraping edge to remove debris from the contact surface before encountering second ramp surface 342 or second ramp flat 333. The presence of second leading face 331 provides a high angle of attack so that any debris or galling on the contact is scraped off of the contact and subsequently, the clean surface of the contact is deflected during insertion by second ramp surface 342. Second ramp flat 333 allows the scraping corner of second ramp shoulder 232 to contact the surface of the electrical contact. Deflection is not caused by second ramp flat 333 as it is level with the direction of insertion, ensuring that pressure and contact are both provided by second ramp shoulder 332. After a substantial amount of the leading edge of a contact has been inserted, the contact encounters second ramp surface 232 which further deflects the contact away from resting position to establish the pressure that will establish a stable connection with a conduit such as second conduit 40 as shown in FIG. 4E. After passing a ramp apex described above, the contact is retained in a detent to maintain stable connection.

Housing bottom 350 and housing top 370 can be threadedly connected to retain the interior elements of the coupling. Housing bottom 350 and housing top 370 can be molded together, welded together, formed together with adhesive, solvent welded, snap fit, or press fit to form a housing comprising a housing top 370 and housing bottom 350. First rear channel guide 371 and second rear channel guide combine with rear shroud 357 to align connection with a connector as shown in FIG. 5.

The many features and advantages of the invention are apparent from the detailed specification and, thus, it is intended by the appended claims to cover all such features and advantages of the invention that fall within the true spirit and scope of the invention. The various elements of the disclosed embodiments can be combined to provide couplings, plugs, and connections that are suited for use with electrical contacts such as high detent contact 110, low detent contact 120 or planar connector 106. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A terminal plug for electrical connection comprising:
a housing having a housing bottom and a housing top;
a first ramp interface comprising a first ramp surface, a first ramp apex, and a first ramp recess;
a first lug disposed in said first ramp recess and spaced apart from said first ramp apex and forming a first ramp detent positioned between said first lug and said first ramp apex;
said first ramp interface and said first lug are retained between said housing top and said housing bottom;
said first lug comprises a first lug ramp positioned below said first ramp apex, and said first ramp detent is adjacent said first ramp apex; and
wherein said first ramp interface is non-conductive.

2. The terminal plug of claim 1 wherein:
said first ramp interface further comprises a first ramp descent;
said housing bottom comprises a first channel ramp having a slope corresponding to said first ramp surface; and
said first lug ramp is adjacent said first ramp descent.

3. The terminal plug of claim 2 wherein:
said first ramp surface has a run length between 0.1 inch and 0.7 inch and a rise height of 0.1 to 0.2 inches;
said first ramp surface provides non-conductive deflection of a conductive contact of at least 0.1 inches to prohibit metal to metal contact until the conductive contact has been inserted into said terminal plug at least 0.25 inches; and
said first ramp apex comprises an apex height of at least 0.02 inches from said first lug ramp, and the conductive contact is deflected at least 0.02 inches by said first lug ramp.

4. The terminal plug of claim 2 further comprising:
a second ramp interface retained between said housing bottom and said housing top;
said second ramp interface comprising a second ramp surface, a second ramp apex, a second ramp descent, and a second lug disposed in a second ramp recess;
said housing bottom comprises a second channel ramp having a slope corresponding to said second ramp surface;
said second lug comprises a second lug ramp positioned below said second ramp apex and forming a second ramp detent adjacent said second ramp descent; and
wherein said second ramp interface is non-conductive.

5. The terminal plug of claim 4 wherein said first ramp interface comprises plastic and said first lug comprises metal.

6. The terminal plug of claim 4 wherein said first ramp interface is composed of injection molded plastic selected from the group of polyamide, PTFE, acetal, and ultra high molecular weight polyethylene.

7. The terminal plug of claim 4 wherein:

said first ramp interface further comprises a first ramp bridge, a first retaining post;

said first ramp surface having a slope of 15 to 45 degrees from horizontal;

said second ramp interface further comprises a second ramp bridge, a second retaining post; and said second ramp surface having a slope of 15 to 45 degrees from horizontal.

8. The terminal plug of claim 4 wherein:

said first ramp apex extends at least 0.01 inches above the immediate adjacent surface of said first lug ramp to create said first ramp detent;

said second ramp apex extends at least 0.01 inches above the immediate adjacent surface of said second lug ramp to create said second ramp detent.

9. The terminal plug of claim 7 wherein:

a guide recess is disposed between said first front channel and said second front channel, and a connecting guide bridge is positioned between said first channel ramp and said second channel ramp;

said first ramp surface interferes with initial conductive contact with said first lug;

said second ramp surface interferes with initial conductive contact with said second lug.

10. The terminal plug of claim 1 wherein said first ramp interface comprises a plastic with a friction coefficient against silver of less than 0.3.

11. The terminal plug of claim 4 wherein:

said first ramp interface further comprises a first leading face distal said first ramp surface, and a first ramp flat adjacent said first ramp surface;

said second ramp interface further comprises a second leading face distal second first ramp surface, and a second ramp flat adjacent said second.

12. The terminal plug of claim 11 further comprising a first ramp shoulder disposed between said first leading face and said first ramp flat, and a second ramp shoulder disposed between said second leading face and said second ramp flat.

13. A coupling for electrical connection comprising:

a first ramp interface comprising a first ramp surface, a first ramp apex, and a first ramp descent disposed adjacent a first surface of a first conduit, said first ramp apex having a vertical height above said first surface of said first conduit forming a first ramp detent configured for retaining an electrical contact;

a first front passage between said first ramp apex and a housing top and defined on at least one side by a front shroud;

said first ramp interface positioned between a housing bottom and a housing top;

said first ramp surface configured to deflect the electrical contact in a vertical direction during horizontal insertion of the electrical contact into said first front passage; and said first ramp surface is non-conductive.

14. The coupling of claim 13 wherein said first ramp surface and second ramp surface comprise a plastic with a friction coefficient against silver less than 0.3.

15. The coupling of claim 13 further comprising:

a second ramp interface comprising a second ramp surface, a second ramp apex, and a second ramp descent disposed adjacent a first surface of a second conduit, said second ramp apex having a vertical height above said first surface of said second conduit forming a detent configured for retaining a second electrical contact;

a second front passage between said second ramp apex and said housing top and defined on at least one side by said front shroud;

said second ramp interface positioned between said housing bottom and said housing top;

said second ramp surface configured to deflect the second electrical contact in a vertical direction during horizontal insertion of the second electrical contact into said second front passage; and said second ramp surface is non-conductive.

16. The coupling of claim 15 further comprising:

a first step interface comprising a first step apex having a vertical height below a second surface of said first conduit forming a first step detent configured for retaining a third electrical contact;

a first rear passage defined between said first step apex and said housing bottom, said first rear passage suited for horizontal insertion of the third electrical contact;

a second step interface comprising a second step apex having a vertical height below a second surface of said second conduit forming a second step detent configured for retaining a fourth electrical contact; and a second rear passage defined between said second step apex and said housing bottom, said second rear passage suited for horizontal insertion of the fourth electrical contact.

17. The coupling of claim 16 wherein:

said housing bottom further comprises a first front channel, a first channel ramp, a second front channel, and a second channel ramp;

a guide bridge connects said first front channel and said second front channel;

a guide recess defined by said first front channel, said second front channel, and said guide bridge;

said front shroud comprises a front side of said housing top;

said first channel ramp comprises a slope corresponding to said first ramp surface; and said first ramp interface comprises non-conductive material and prevents initial contact between a first electrical contact and said first conduit until at least half of horizontal insertion of the first electrical contact into said first front passage; and said second ramp interface comprises non-conductive material and prevents initial contact between the second electrical contact and said second conduit until at least half of horizontal insertion of the second electrical contact into said second front passage.

18. The coupling of claim 17 wherein:

said housing top further comprises a first rear channel guide exterior said first step interface, and a second rear channel guide exterior said second step interface;

said first step interface extends above said first step detent by at least 0.02 inches; and said second step interface extends above said second step detent by at least 0.02 inches.

19. The coupling of claim 18 further comprising:

A locking mechanism comprising a first incline hook connected to said first rear channel guide and projecting toward said housing bottom.

20. The coupling of claim 18 further comprising:

a locking mechanism comprising a first torsion pivot connecting a first torsion arm to said first rear channel guide;

a first incline hook disposed on said first torsion arm and projecting toward said housing bottom.

21. The coupling of claim 20 wherein:

said locking mechanism further comprises a second torsion pivot connecting a second torsion arm to said second rear channel guide;

a second incline hook disposed on said second torsion arm and projecting toward said housing bottom;

said housing bottom comprises a lock access recess; and a lock bridge connecting said first torsion arm to said second torsion arm is positioned interior said lock access recess.

22. The coupling of claim 17 wherein:

said first step interface comprises non-conductive material and prevents initial contact between the third electrical contact and said second surface of said first conduit;

said second step interface comprises non-conductive material and prevents initial contact between the fourth electrical contact and said second surface of said second conduit.

23. The coupling of claim 22 wherein:

said first step interface is comprised of plastic with a coefficient of friction against silver of less than 0.3;

said second step interface is comprised of plastic with a coefficient of friction against silver of less than 0.3.

24. The device of claim 15 wherein:

said first ramp surface has a run length of 0.2 to 0.5 inches and a rise of 0.1 to 0.2 inches to deflect the first electrical contact upon insertion into first front channel by a minimum 0.08 inches over the course of insertion travel against said non-conductive first ramp surface before the first electrical contact makes electrical connection with said first conduit.

25. The coupling of claim 15 wherein:

said first ramp interface further comprises a first leading face extending into said first front passage, and a first ramp flat disposed between said first leading face and said first ramp surface;

said second ramp interface further comprises a second leading face extending into said second front passage, and a second ramp flat disposed between said second leading face and said second ramp surface.

26. The coupling of claim 25 further comprising a first ramp shoulder disposed between said first leading face and said first ramp flat, and a second ramp shoulder disposed between said second leading face and said second ramp flat.

27. A terminal plug for electrical connection comprising:

a housing retaining a non-conductive threshold and an electrical conduit;

said non-conductive threshold is configured to delay electrical contact of an inserted electrical connector with said electrical conduit;

said non-conductive threshold is located adjacent to said electrical conduit;

said non-conductive threshold comprises a step ascent, a step apex, and a step descent, wherein said step apex extends above said electrical conduit to form a step detent configured to retain the electrical connector;

said step apex causes deflection of the electrical connector away from said electrical conduit upon insertion of the electrical connector into said housing; and said step apex causes deflection of the electrical connector away from said electrical conduit upon removal of the electrical connector from said housing.

* * * * *